US010085556B2

(12) United States Patent
Chien et al.

(10) Patent No.: US 10,085,556 B2
(45) Date of Patent: Oct. 2, 2018

(54) DRAWER CABINET PROVIDED WITH ADJUSTABLE DRAWER ASSEMBLY MODE

(71) Applicants: Li-Chen Chien, Changhua (TW); Hsiu-Yi Chien, Changhua (TW)

(72) Inventors: Li-Chen Chien, Changhua (TW); Hsiu-Yi Chien, Changhua (TW)

( * ) Notice: Subject to any disclaimer, the term of this patent is extended or adjusted under 35 U.S.C. 154(b) by 0 days.

(21) Appl. No.: 15/325,201

(22) PCT Filed: Aug. 10, 2015

(86) PCT No.: PCT/CN2015/086454

§ 371 (c)(1),
(2) Date: Jan. 10, 2017

(87) PCT Pub. No.: WO2016/023447

PCT Pub. Date: Feb. 18, 2016

(65) Prior Publication Data

US 2017/0172298 A1 Jun. 22, 2017

(30) Foreign Application Priority Data

Aug. 13, 2014 (CN) ..... 2014 1 0396030

(51) Int. Cl.
*A47B 88/00* (2017.01)
*A47B 88/40* (2017.01)
*A47B 88/70* (2017.01)

(52) U.S. Cl.
CPC ..... *A47B 88/40* (2017.01); *A47B 88/70* (2017.01)

(58) Field of Classification Search
CPC ..... A47B 88/40; A47B 88/70
(Continued)

(56) References Cited

U.S. PATENT DOCUMENTS 628,322 A 7/1899 Hoffmire
628,333 A 7/1899 Hoffmire
846,881 A * 3/1907 Walton ..... A47B 87/02 312/107

(Continued)

FOREIGN PATENT DOCUMENTS

CN 102829044 A 12/2012
CN 202723127 U 2/2013

(Continued)

*Primary Examiner* — Janet M Wilkens
(74) *Attorney, Agent, or Firm* — Alan D. Kamrath; Kamrath IP Lawfirm, P.A.

(57) ABSTRACT

A drawer cabinet has an adjustable drawer assembly mode. The drawer cabinet includes a cabinet body (10) and at least one drawer unit (20). The cabinet body (10) includes a rectangular receiving space (11) and at least one opening (12) in communication with the receiving space (11). Each of four corners of the receiving space (11) is combined with a slide rail (30). Each of the slide rails (30) includes a sliding channel (32) that faces the receiving space (11) and section shapes of which are symmetrical relative to an angular bisector. The drawer unit (20) is slidably combined with the receiving space (11), and an upper edge or a lower edge of two sides of the drawer unit (20) is at least provided with a pair of connection units (40). Each of the connection units (40) is slidably combined with the corresponding slide rail (30) and is provided with a sliding rod (41) that matches the sliding channel (32). The four corners of the receiving space (11) of the cabinet body (10) are provided with the slide rails (30) without assembly direction limitations, so that the assembly directions and the assembly quantity of the drawers are not limited, and so that the flexibility and the variability of arranging drawers in the drawer cabinet are effectively improved.

15 Claims, 15 Drawing Sheets

(58) Field of Classification Search
USPC ..... 312/330.1, 334.7, 107, 108, 111, 198, 312/287, 289
See application file for complete search history.

(56) References Cited

U.S. PATENT DOCUMENTS 1,076,116 A * 10/1913 Hatfeild ..... A47B 87/02 312/111
2,169,769 A * 8/1939 Regenhardt ..... A47B 87/02 312/111
2,676,861 A * 4/1954 Belew ..... G11B 33/0444 220/23.6
3,529,878 A * 9/1970 Blowers ..... A47B 87/0292 312/107
3,974,898 A * 8/1976 Tullis ..... A45C 7/0045 190/108
4,239,306 A * 12/1980 Klaus ..... A47B 47/06 211/194
5,421,653 A * 6/1995 Triplette ..... F16C 33/02 312/334.32
5,735,407 A * 4/1998 Kallio ..... H05K 7/1424 206/707
2004/0263031 A1* 12/2004 Irizarry ..... A47B 67/04 312/330.1

FOREIGN PATENT DOCUMENTS

| | | | | |
|---|---|---|---|---|
| DE | 2424145 | A1 | | 11/1975 |
| DE | 10160914 | | * | 7/2003 |
| DE | 10230545 | A1 | | 1/2004 |
| JP | S5359919 | U | | 5/1978 |
| JP | H0451247 | U | | 4/1992 |
| JP | 3011056 | U | | 5/1995 |
| JP | 3185386 | U | | 8/2013 |
| KR | 20060016350 | | * | 2/2006 |
| TW | M333110 | U | | 6/2008 |
| TW | 201446186 | A | | 12/2014 |
| WO | 2005084490 | | * | 9/2005 |

* cited by examiner

DRAWER CABINET PROVIDED WITH ADJUSTABLE DRAWER ASSEMBLY MODE

BACKGROUND OF THE INVENTION

1. Field of the Invention

The present invention relates to a drawer cabinet for a desk or a cabinet and, more particularly, to a drawer cabinet with changeable arrangements of drawers.

2. Description of Related Art

Furniture, such as a desk, a storage cabinet, a combination cabinet or a wardrobe, usually has a drawer cabinet for disposing drawers to provide an object receiving and storage space. However, the arrangement and assembling direction of the conventional drawers for furniture are fixed. The position, amount, and operation direction of the drawers cannot be changed for different use demands. The drawers cannot be changed to a vertical disposition or a lateral disposition and cannot fit with different needs of different users.

SUMMARY OF THE INVENTION

To overcome the shortcoming of the fixed arrangement of the drawers that cannot fit with different needs of use, the main objective of the invention is to provide a drawer cabinet with changeable arrangements of drawers. Particularly, multiple rails are mounted on four corners of a receiving space of a cabinet body and are free from limitation in assembling directions. Thus, the assembling direction and amount of drawers are not limited, and the drawers are versatile in use.

To achieve the aforementioned objective, a drawer cabinet in accordance with the present invention comprises:

a cabinet body having at least one rectangular receiving space and at least one opening communicating with the at least one receiving space, with each one of the at least one receiving space having multiple rails mounted respectively on four corners of the receiving space, with each rail having two rail bodies connected with each other at an angle of 90° and a sliding channel defined between the rail bodies and facing the receiving space, and with the sliding channel of each rail having a shape being symmetric with respect to a diagonal line of the two rail bodies of the rail; and at least one drawer unit mounted slidably in each one of the at least one receiving space, with each one of the at least one drawer unit having at least one pair of connection units, and with each connection unit connected slidably with a respective one of the multiple rails and comprising a sliding rod.

Each rail comprises an escaping notch defined in an outer corner of a conjunction of the two rail bodies of the rail.

The sliding channel of each rail comprises two rectangular channel grooves, and the sliding rod of each connection unit comprises two rod bodies symmetric to each other.

Each connection unit is connected integrally with a corresponding one of the at least one drawer unit.

Each connection unit comprises a connection board abutting a corresponding one of the at least one drawer unit, and the sliding rod is connected with a side edge of the connection board.

Each connection unit comprises a connection board abutting a corresponding one of the at least one drawer unit and an extension tab extending inclinedly from a side edge of the connection board, and the sliding rod is connected with a side edge of the extension tab.

The cabinet body further comprises at least one dual rail, and each one of the at least one dual rail comprises a rail board, a baffle connected perpendicularly with the rail board, and two sliding channels located respectively at two sides of the baffle and being symmetric with respect to a diagonal line of the dual rail.

Each one of the at least one drawer unit comprises two pairs of connection units mounted respectively on top edges and bottom edges of two sides of the drawer unit.

The cabinet body comprises at least two openings in at least two perpendicular directions. Each one of the at least one receiving space comprises two groups of four rails mounted respectively on four corners of the receiving space respectively along each of the at least two openings in the at least two perpendicular directions, and each rail is discontinuous at a conjunction with a perpendicular corresponding rail.

With the aforementioned technique features, the present invention can achieve the following advantages.

1. With the four rails with L-shaped cross sections mounted respectively on four corners of the receiving space of the cabinet body and with the shape of each rail being symmetric with respect to a diagonal line, the drawer units can be mounted in the cabinet body in any direction even when the cabinet is disposed vertically or horizontally. The versatility of arranging drawer units is improved.

2. With the four rails mounted respectively on four corners of the receiving space of the cabinet body, one or two drawer unit(s) can be mounted in the receiving space. The amount of the drawer units is not limited. When the receiving space further has dual rails, the amount and dimensions of the drawer units can be effectively changed, and the versatility of assembling the drawer cabinet is improved.

3. The cabinet body may have multiple openings in different directions and communicating with the receiving space, and multiple rails are mounted in the receiving space in different directions and are kept from interfering with each other. Thus, the amount, the assembling positions, and the operational directions of the drawer units can be freely changed and adjusted to fit with different use demands.

Other objectives, advantages and novel features of the invention will become more apparent from the following detailed description when taken in conjunction with the accompanying drawings.

LIST OF REFERENCE NUMERALS

| | |
|---|---|
| 10, 10A, 10B cabinet body | 11 receiving space |
| 12 opening | 13 corner post |
| 14 cabinet board | |
| 20, 20A, 20B, 20C, 20D, 20E, 20F drawer unit | |
| 21 side panel | 22 front panel |
| 221 pulling segment | 23 rear panel |
| 24 bottom panel | 25 holding space |
| 30, 30A rail | 30B dual rail |
| 31, 31A rail body | 31B baffle |
| 32 sliding channel | 321 channel groove |
| 33 escaping notch | |
| 40, 40A, 40B connection unit | 41 sliding rod |
| 411 rod body | 412 guiding edge |
| 42 connection board | 421 recess |
| 422 extension tab | 43 screw |
| B diagonal line | |

DETAILED DESCRIPTION OF PREFERRED EMBODIMENTS

Figure 1:
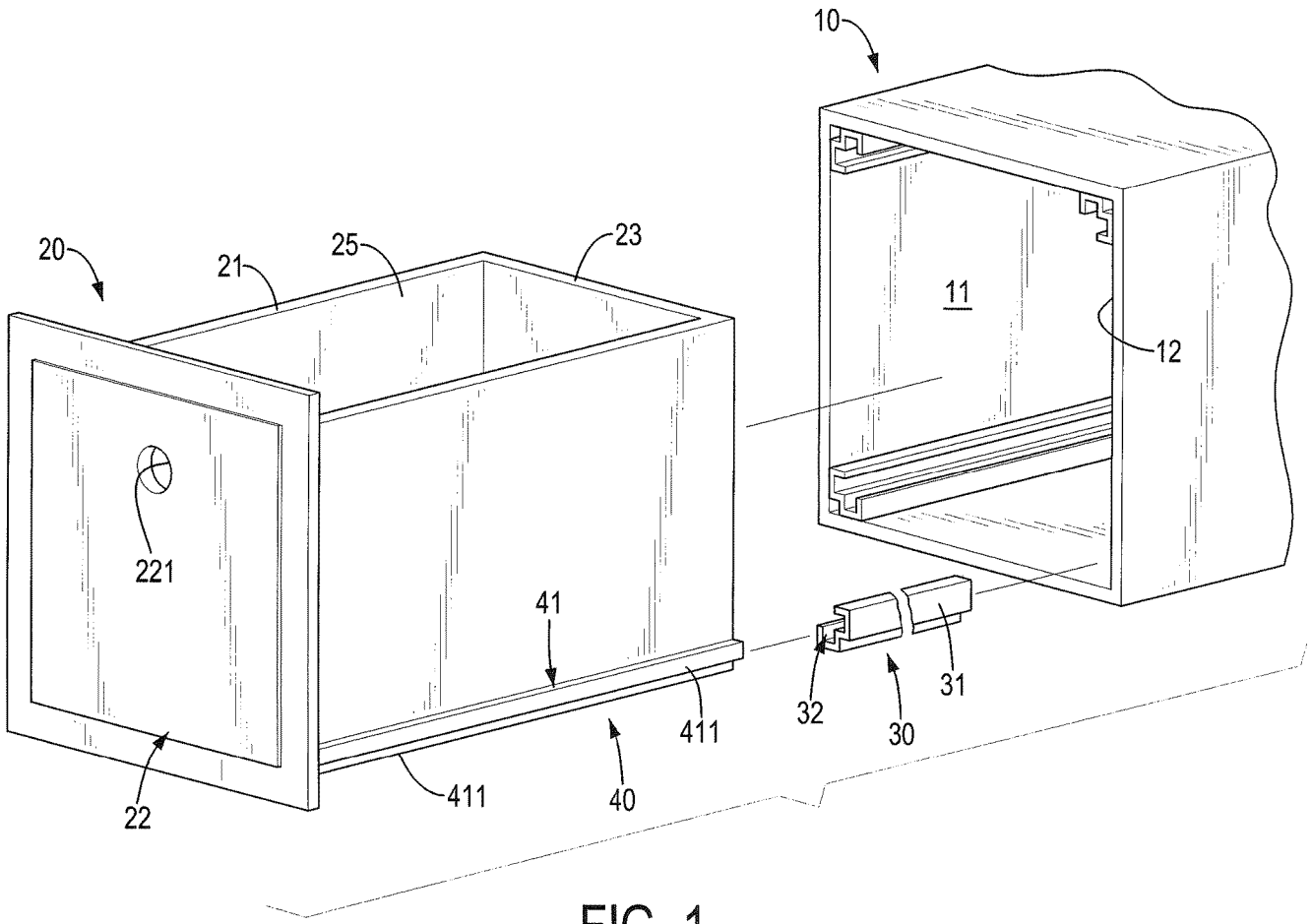
FIG. 1 is an exploded perspective view of a first embodiment of a drawer cabinet in accordance with the present invention.
Figure 2:
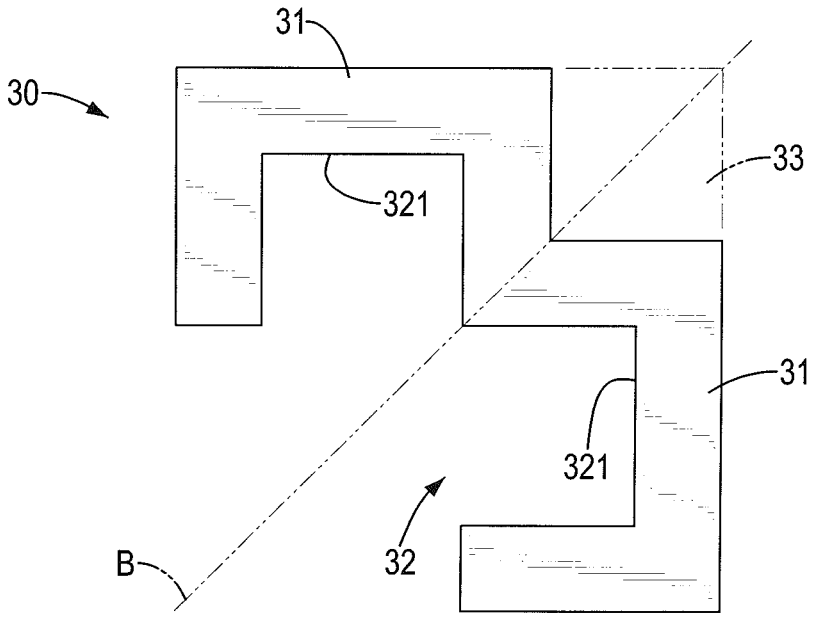
FIG. 2 is an end view of a rail of the first embodiment of the drawer cabinet in accordance with the present invention.
Figure 3:
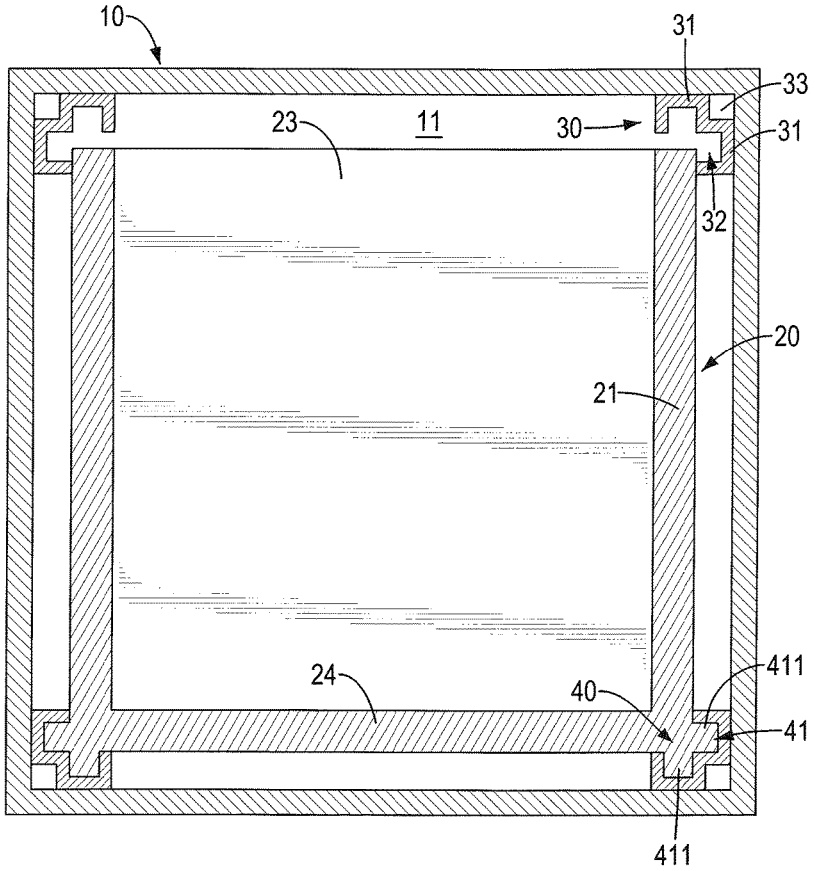
FIG. 3 is a cross sectional side view of the first embodiment of the drawer cabinet in accordance with the present invention.

A drawer cabinet in accordance with the present invention is capable of changing the arrangement of drawers and may be an individual cabinet or a part of a piece of furniture, such as a desk, a storage cabinet or a wardrobe, and the present invention does not set limitations on this aspect. A cabinet adapted to hold drawers inside is a drawer cabinet in accordance with the present invention. With reference to FIGS. 1 to 3, a first embodiment of a drawer cabinet in accordance with the present invention comprises a cabinet body 10, a drawer unit 20 mounted slidably in the cabinet body 10, four rails 30 mounted in the cabinet body 10, and two connection units 40 mounted on the drawer unit 20.

The cabinet body 10 comprises a rectangular receiving space 11 and an opening 12 communicating with the receiving space 11. The cabinet body 10 may be made of, but is not limited to, wood, plastic material or metal. Preferably, the opening 12 is rectangular in shape.

The drawer unit 20 is mounted slidably in the receiving space 11 in the cabinet body 10 and comprises two parallel side panels 21, a front panel 22, a rear panel 23, and a bottom panel 24. The front panel 22 is connected with front ends of the side panels 21 and has size dimensions larger than those of the opening 12. The rear panel 23 is connected with the rear ends of the side panels 21. The bottom panel 24 is arranged at a bottom of the drawer unit 20. A holding space 25 is defined between the panels 21,22,23,24. A handle, a recess or a cavity may be disposed on the front panel to serve as a pulling segment 221.

The four rails 30 each have an L-shaped cross section and are mounted respectively on four corners of the receiving space 11. Each rail 30 may be made by aluminum extrusion, aluminum die-casting, or mold injection and comprises two rail bodies 31 connected with each other at an angle of 90°. A sliding channel 32 is defined between the rail bodies 31. With reference to FIG. 2, the sliding channel 32 is symmetric with respect to a diagonal line B of the two rail bodies 31 of the rail 30, and the cross section of the sliding channel 32 may be C-shaped, isosceles, or trapezoidal in shape. Preferably, the sliding channel 32 comprises two rectangular channel grooves 321 being symmetric to each other. In addition, each rail 30 comprises an escaping notch 33 defined in an outer corner of a conjunction of the rail bodies 31 to enable the rail 30 to be assembled easily and to reduce the manufacture material for the rail 30.

The two connection units 40 are symmetric to each other and are mounted respectively on the bottom edges of outer sides of the side panels 21 of the drawer unit 20. Preferably, each connection unit 40 is connected integrally with the corresponding side panel 21. Each connection unit 40 comprises a sliding rod 41 corresponding to the sliding channel 32 in size dimensions and shape. Preferably, the sliding rod 41 comprises two rod bodies 411 corresponding to the rectangular channel grooves 321.

With reference to FIGS. 1 to 3, four rails 30 with L-shaped cross sections are mounted on the corners of the receiving space 11 of the cabinet body 10. Because the shape of the sliding channel 32 is symmetric with respect to the diagonal line B, the shape and position of the rail 30 is kept from changing and is free from being limited in directions when the cabinet body 10 is arranged vertically or horizontally. The drawer unit 20 can be put slidably into the receiving space 11 via the opening 12 smoothly, so the versatility of assembling the drawer cabinet can be improved.

Figure 4:
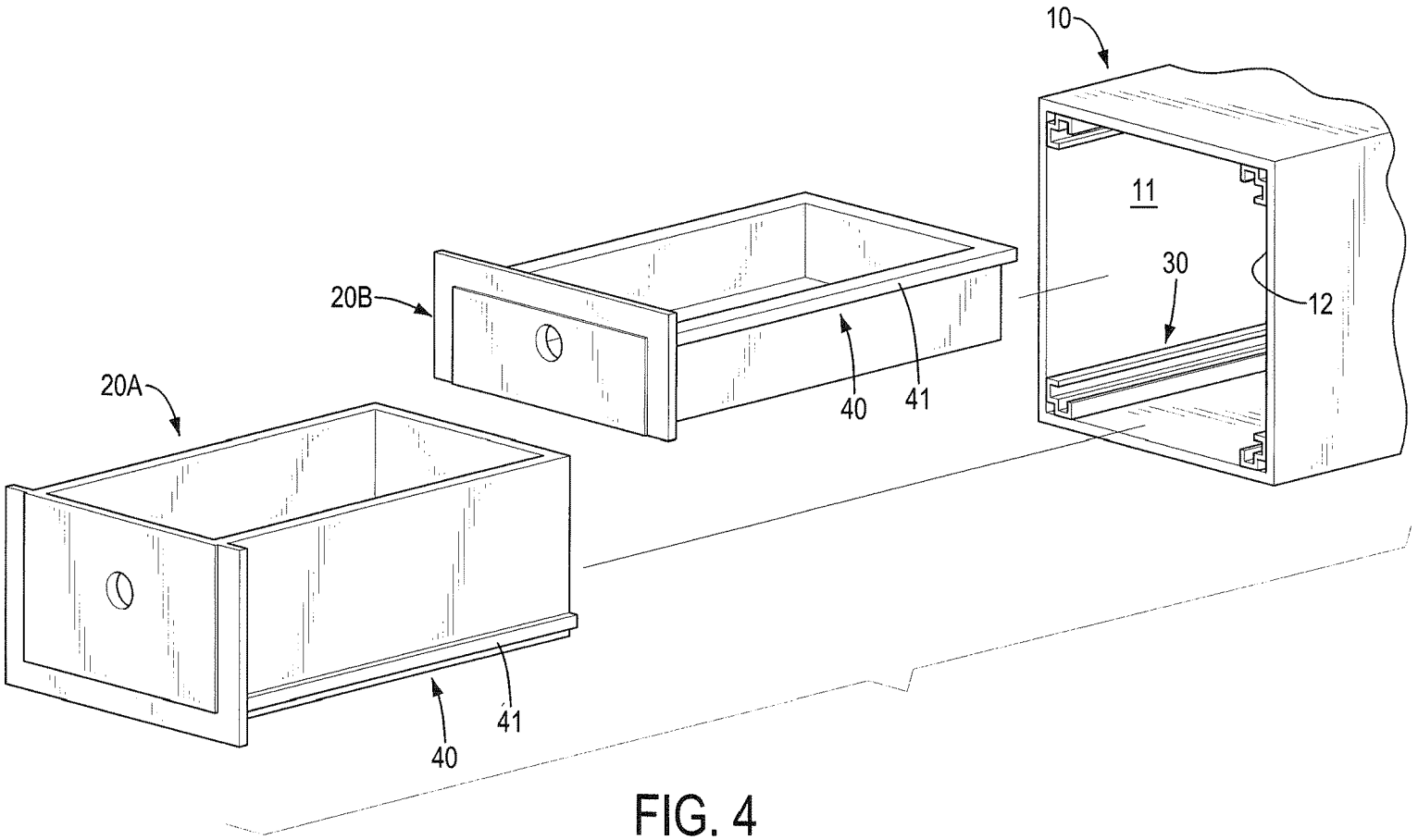
FIG. 4 is an exploded perspective view of a second embodiment of a drawer cabinet in accordance with the present invention.
Figure 5:
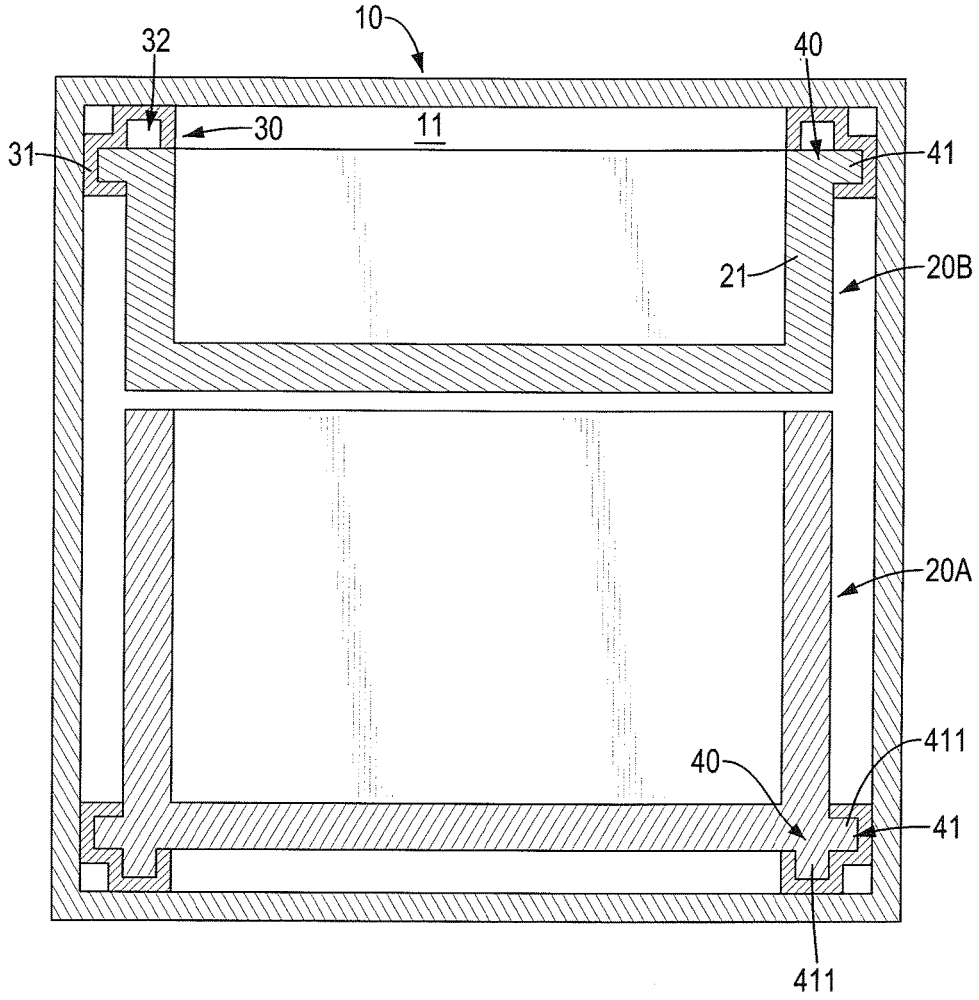
FIG. 5 is a cross sectional side view of the second embodiment of the drawer cabinet in accordance with the present invention.

With reference to FIGS. 4 and 5, in the second embodiment, the difference from the first embodiment is that two drawer units 20A, 20B are implemented. The lower drawer unit 20A has a height about two-thirds of the height of the drawer unit 20 in the first embodiment and is mounted slidably in the cabinet body 10 by the connection units 40. The upper drawer unit 20B has a height about one-thirds of the height of the drawer unit 20 in the first embodiment and has a pair of connection units 40 mounted respectively on top edges of the outer sides of the side panels of the drawer unit 20B. Each connection unit 40 comprises a sliding rod 41 corresponding to the rectangular channel grooves 321, such that the drawer unit 20B is mounted slidably in the cabinet body 10 by the connection units 40.

With reference to FIGS. 1 to 5, in a cabinet body 10 that has four rails 30 mounted therein, one or two drawer unit(s) 20,20A,20B can be mounted in the receiving space 11. Thus, the amount and assembling direction of the drawer unit 20,20A,20B are not limited.

Figure 6:
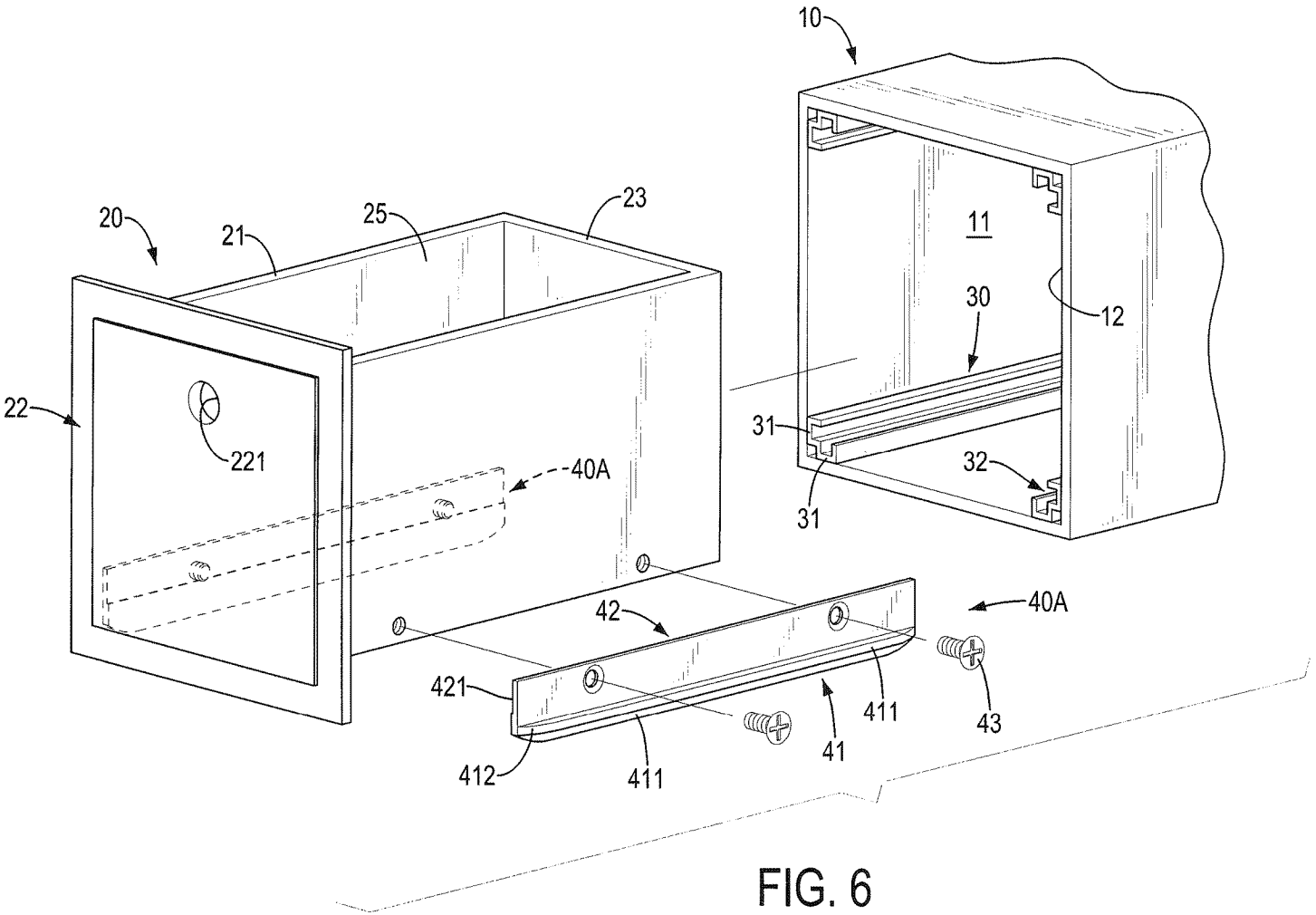
FIG. 6 is an exploded perspective view of a third embodiment of a drawer cabinet in accordance with the present invention.
Figure 7:
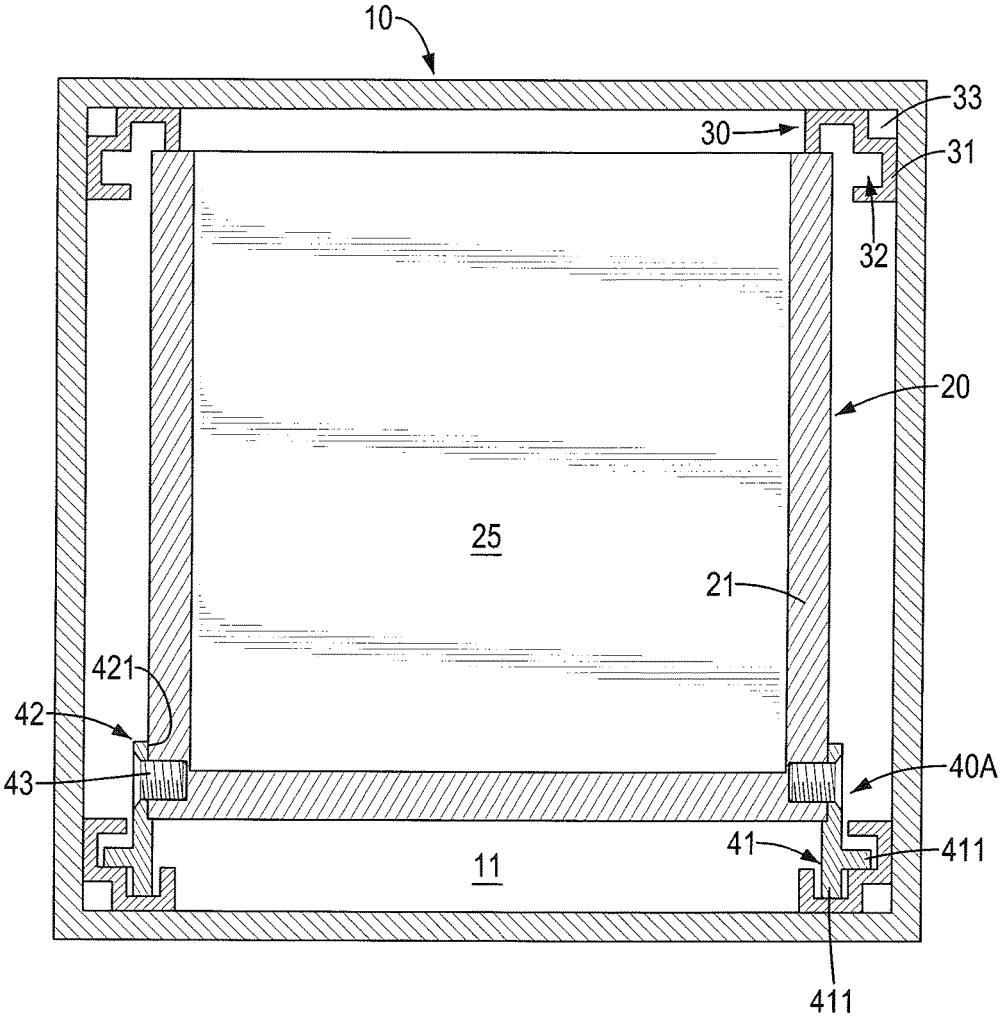
FIG. 7 is a cross sectional side view of the third embodiment of the drawer cabinet in accordance with the present invention.

With reference to FIGS. 6 and 7, in the third embodiment, the difference from the first embodiment is that the connection units 40A are detachable. The connection unit 40A may be made by aluminum extrusion, aluminum die-casting, or mold injection and comprises a connection board 42 and a sliding rod 41. The connection board 42 is applied to abut the side of the drawer unit 20. A recess 421 is defined in the connection board 42 at a side abutting the drawer unit 20, and the connection board 42 can be securely connected with the drawer unit 20 by adhesive or screws 43. The sliding rod 41 is connected with a side edge of the connection board 42. The sliding rod 41 comprises two rod bodies 411 corresponding to the rectangular channel grooves 321. Each rod body 411 has a curved guiding edge 412 formed on one end of the rod body 411, such that the drawer unit 20 is slidably connected with the cabinet body 10 with the connection units 40A.

Figure 8:
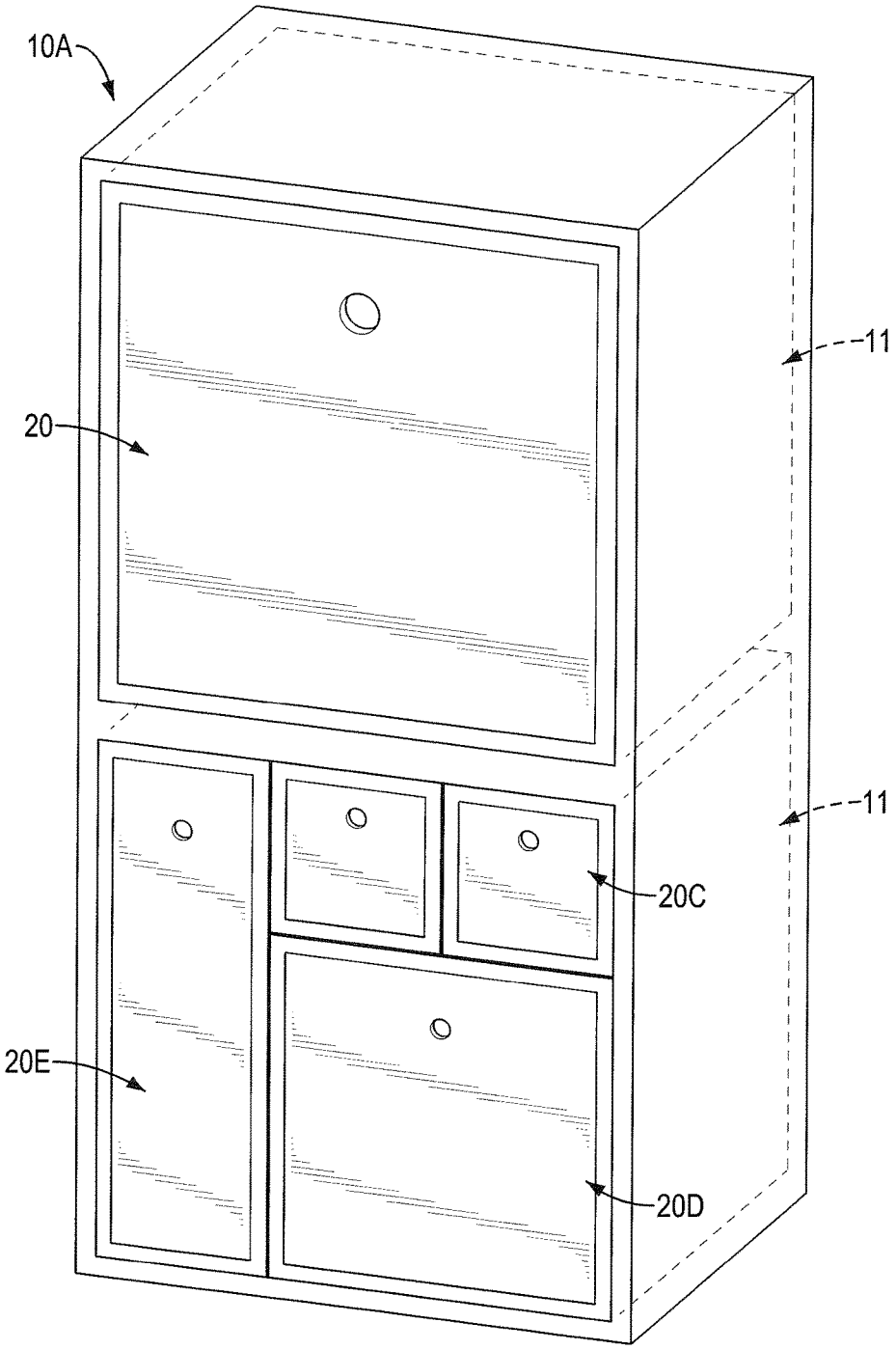
FIG. 8 is a perspective view of a fourth embodiment of a drawer cabinet in accordance with the present invention arranged in a vertical manner.
Figure 12:
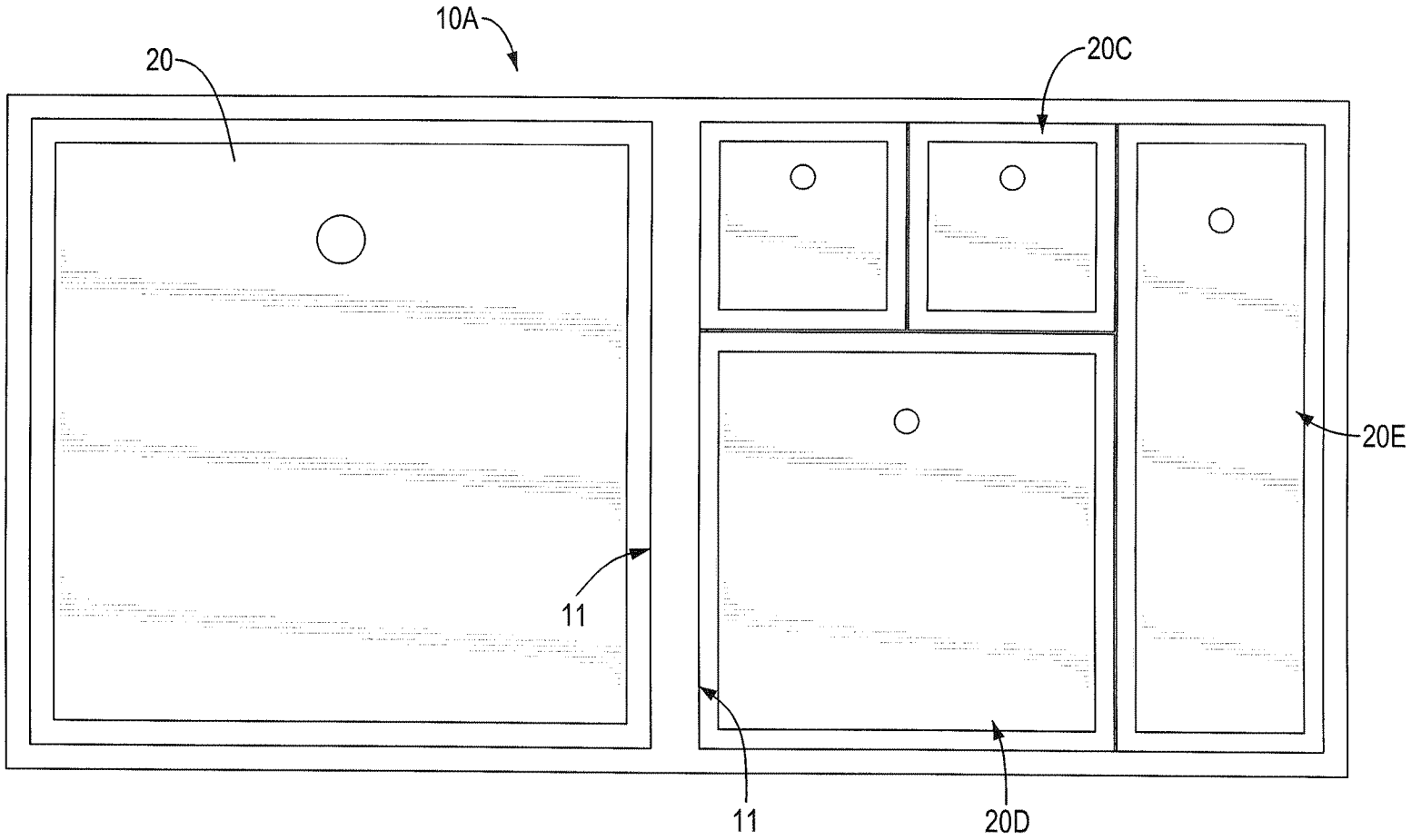
FIG. 12 is a perspective view of the fourth embodiment of the drawer cabinet in accordance with the present invention arranged in a horizontal manner.

With reference to FIGS. 8 and 12, in a fourth embodiment, the drawer cabinet comprises a cabinet body 10A, multiple drawer units 20,20C,20D,20E mounted slidably in the cabinet body 10A, multiple rails 30A and dual rails 30B mounted in the cabinet body 10A, and multiple connection units 40B mounted on the drawer units 20,20C,20D,20E.

Figure 9:
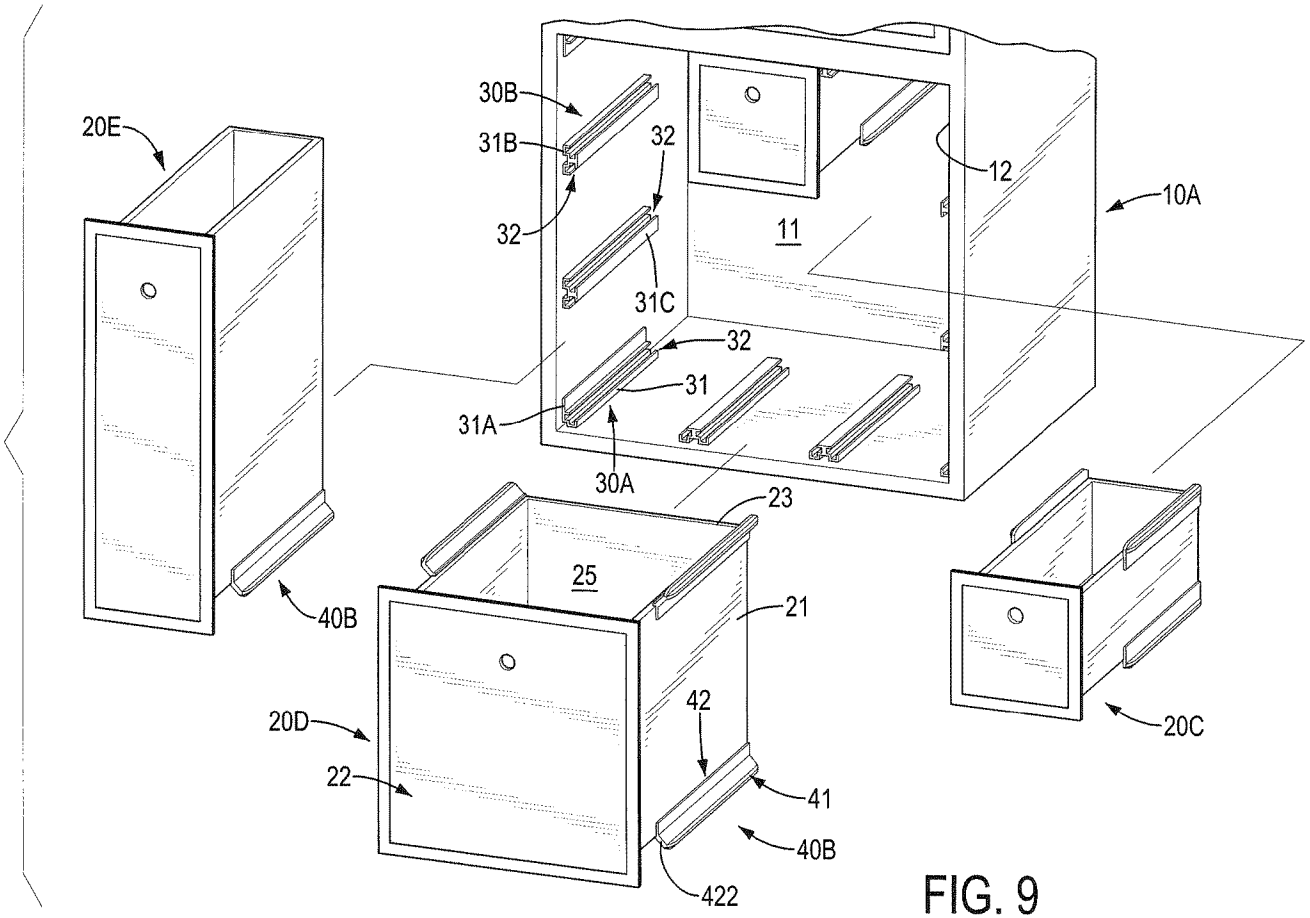
FIG. 9 is a partially exploded perspective view of the fourth embodiment of the drawer cabinet in accordance with the present invention.
Figure 10:
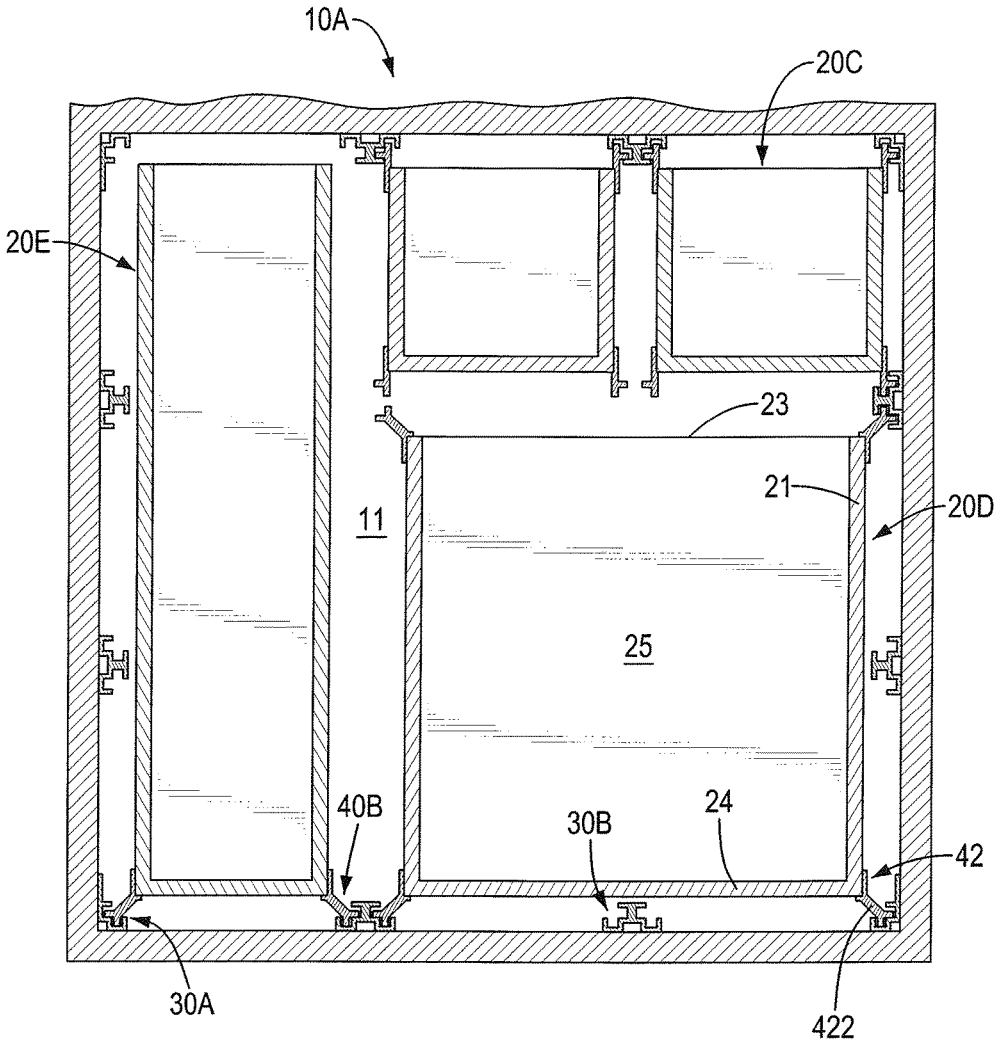
FIG. 10 is a cross sectional side view of the fourth embodiment of the drawer cabinet in accordance with the present invention.
Figure 11:
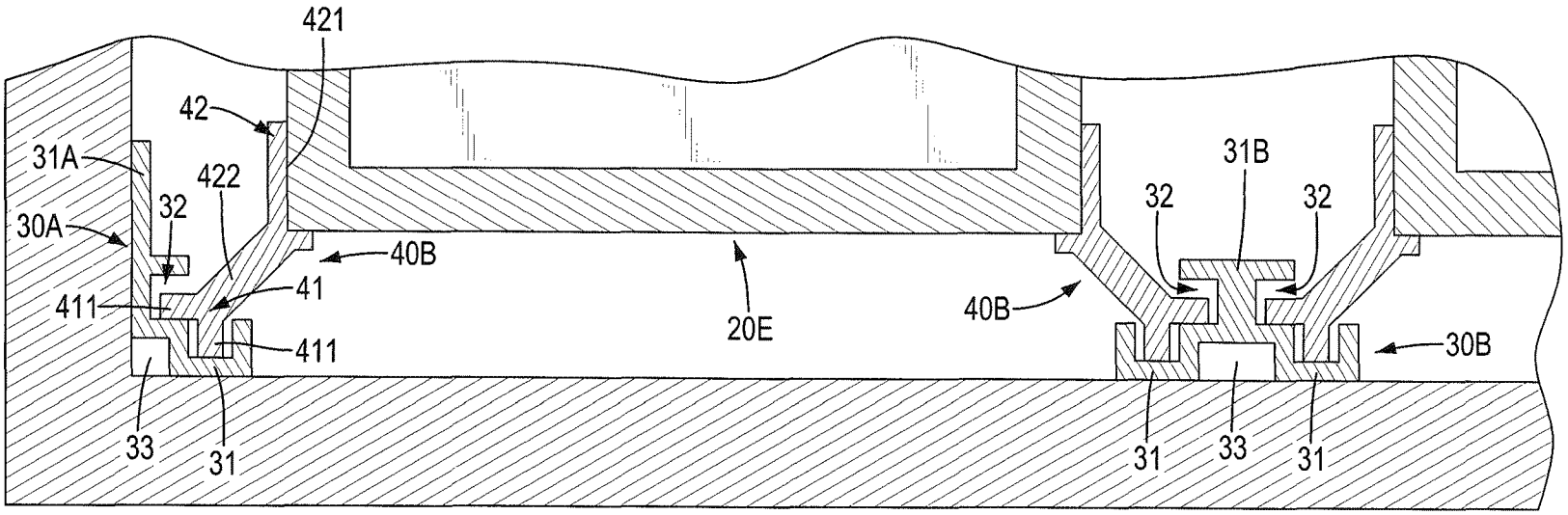
FIG. 11 is an enlarged cross sectional side view of the fourth embodiment of the drawer cabinet in accordance with the present invention.

With reference to FIGS. 8 and 9, the cabinet body 10A is rectangular in cross section and comprises two rectangular receiving spaces 11 and two openings 12 communicating respectively with the receiving spaces 11. One drawer unit 20 of the largest size dimensions is mounted in one of the receiving spaces 11, and four drawer units 20C,20D,20E of different size dimensions are mounted in the other receiving space 11. With reference to FIGS. 9 to 11, the receiving space 11 is divided into nine segments in a 3-by-3 grid. Four rails 30A with L-shaped cross sections are mounted respectively on four corners of the receiving space 11. Multiple dual rails 30B are mounted respectively on trisection positions of each inner wall of the receiving space 11. The rails 30A are similar to the rails 30 in the first embodiment except that a positioning segment extends from a side edge of one of the rail bodies 31A. The dual rail 30B is substantially composed of two rails 30 with L-shaped cross sections connected integrally with each other and comprises a rail body 31, a baffle 31B, and two sliding channels 32. The baffle 31B is connected perpendicularly with a middle of the rail board 31. The two sliding channels 32 are located respectively at two sides of the baffle 31B and are symmetric with respect to a diagonal line. An escaping notch 33 is defined in an outer corner of a conjunction of the rail body 31 and the baffle 31B to reduce the manufacture material for the dual rail 30B.

To fit with the nine segments of the receiving space 11, two drawer units 20C each in size dimensions of one segment, one drawer unit 20D in size dimensions of four segments, and one drawer unit 20E in size dimensions of three segments are implemented. To allow the drawer units 20C,20D to be mounted in the receiving space 11 in any desired arrangement, two pairs of connection units 40B are mounted respectively on top edges and bottom edges of the side panels 21 of each rectangular drawer unit 20C,20D. Two connection units 40B are mounted respectively on bottom edges of the side panels 21 of the rectangular drawer unit 20E. Each connection unit 40B comprises a connection board 42, an extension tab 422, and a sliding rod 41. The connection board 42 abuts a corresponding drawer unit 20,20C,20D,20E. The extension tab 422 extends inclinedly from a side edge of the connection board 42 at an angle of 45°. The sliding rod 41 is connected with a side edge of the extension tab 422. The sliding rod 41 comprises two rod bodies 411 corresponding to the rectangular channel grooves 321 of the sliding channel 32. The drawer units 20,20C,20D,20E are connected with the rails 30A or the dual rails 30B in the cabinet body 10A with the connection units 40B.

With reference to FIGS. 8, 9, and 12, each receiving space 11 in the cabinet body 10A has multiple rails 30A and dual rails 30B arranged in a 3-by-3 grid. With the shape of the sliding channel 32 of each rail 30A,30B having rail body 31C being symmetric with respect to a diagonal line, the drawer units 20,20C,20D,20E can be slidably mounted in the receiving spaces 11 in the cabinet body 10A in a vertical or a horizontal arrangement. Therefore, the assembling positions of the drawer units 20,20C,20D,20E can be changed, such that the amount, assembling direction and size dimensions of the drawer units 20,20C,20D,20E can be changed to fit with different use needs or demands.

Figure 13:
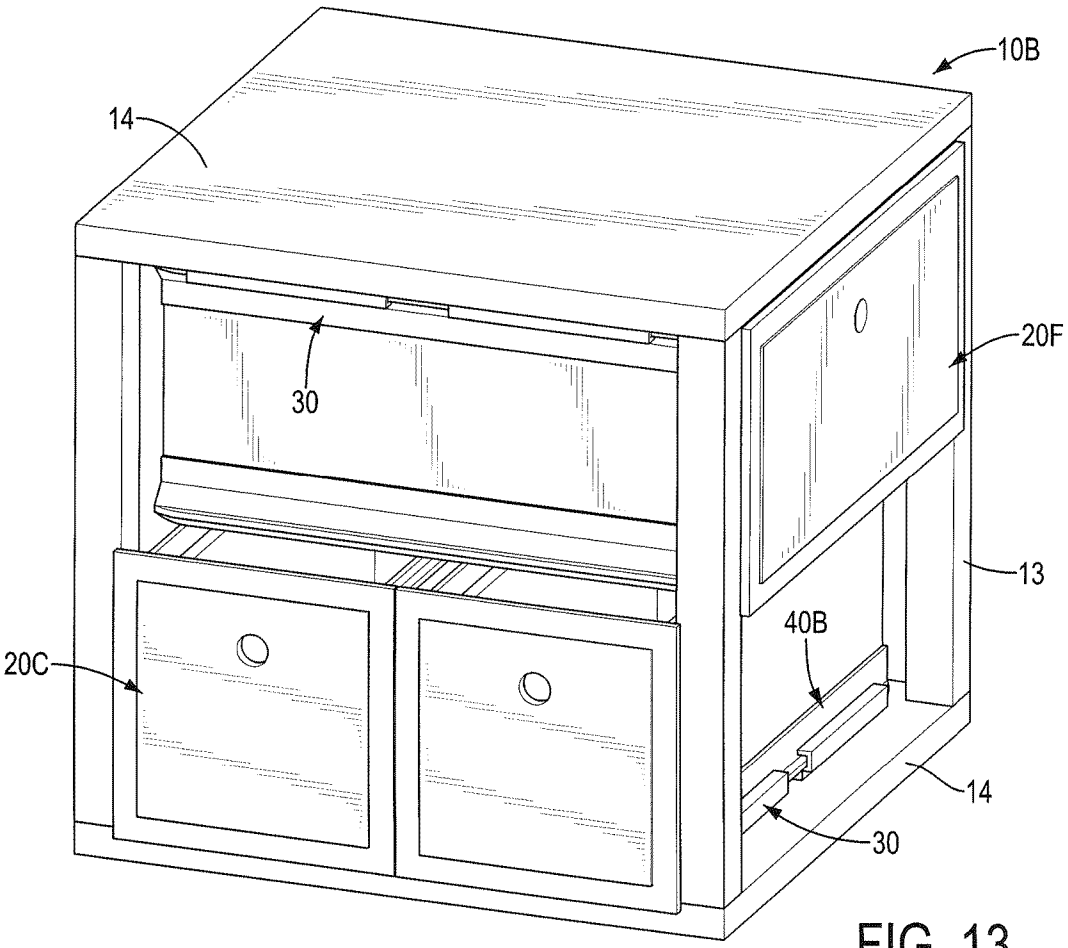
FIG. 13 is a perspective view of a fifth embodiment of a drawer cabinet in accordance with the present invention.
Figure 14:
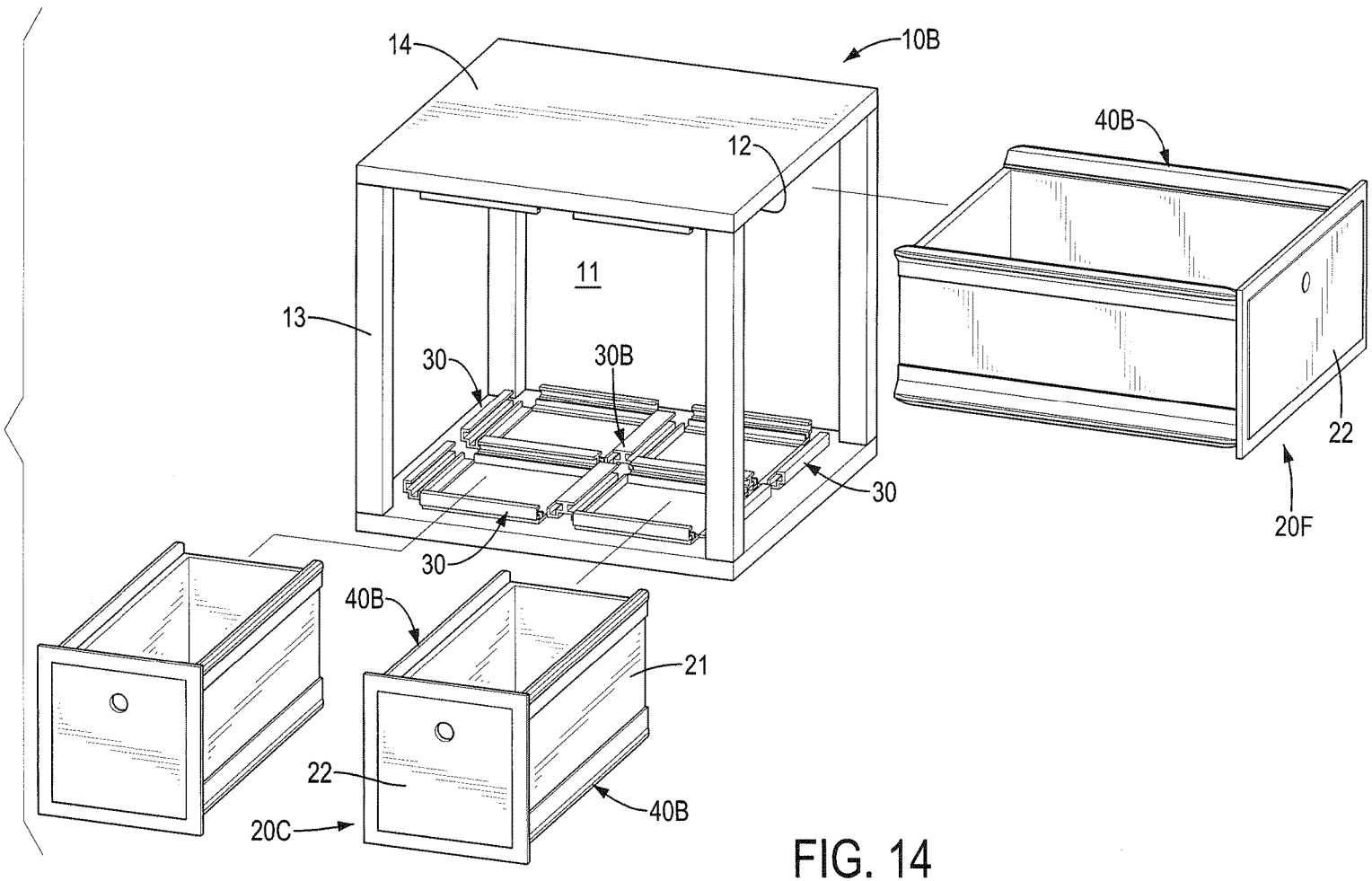
FIG. 14 is an exploded perspective view of the fifth embodiment of the drawer cabinet in accordance with the present invention.
Figure 15:
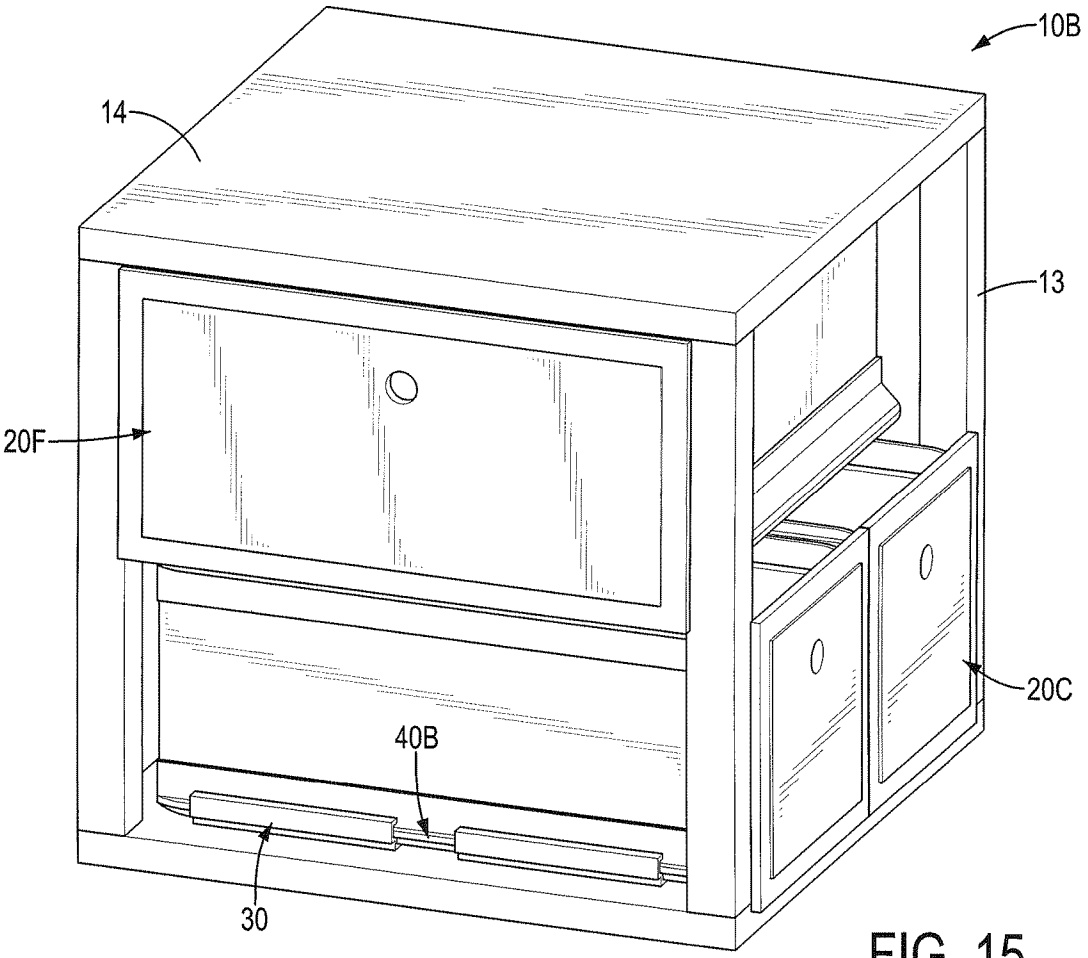
FIG. 15 is an operational perspective view of the fifth embodiment of the drawer cabinet in accordance with the present invention.

With reference to FIGS. 13 to 15, in the fifth embodiment, the drawer cabinet comprises a cabinet body 10B, multiple drawer units 20C,20F mounted slidably in the cabinet body 10B, multiple rails 30A and dual rails 30B mounted in the cabinet body 10B, and multiple connection units 40B mounted on the drawer units 20C,20F. The cabinet body 10B is composed of four corner posts 13 disposed respectively at four corners of the cabinet body 10B and two cabinet boards 14 connected respectively to tops and bottoms of the corner posts 13. The cabinet body 10B has a rectangular receiving space 11 and four openings 12 in four perpendicular directions, being at an angle of 90° with respect to each other and communicating with the receiving space 11.

The receiving space 11 is divided into four segments in a 2-by-2 gird. Two groups of four rails 30A are mounted respectively on four corners of the receiving space 11 respectively along each of two perpendicular directions. Two dual rails 30B are mounted respectively at middle positions of each cabinet board 14 respectively along each of the two perpendicular directions. Each rail 30A,30B is discontinuous at a conjunction with a perpendicular corresponding rail to keep the rail 30A,30B from interfering with each other. Preferably, a connector may be mounted on each conjunction of the discontinuous rails 30A, 30B, such that the rails 30A,30B can be smoothly connected with each other. To fit with the four segments of the receiving space 11, two drawer units 20C each in size dimensions of one segment and one drawer unit 20F in size dimensions of two segments are implemented. Two connection units 40B are mounted respectively on a top edge and a bottom edge of the side panels 21 of each drawer unit 20C,20F.

With reference to FIGS. 13 to 15, with the rails 30A and dual rails 30B arranged along the two perpendicular directions, the amount, the assembling positions, and the operational directions of the drawer units 20C,20F can be freely changed and adjusted to fit with different use demands.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drawer cabinet comprising:

a cabinet body comprising at least one rectangular receiving space, at least one opening communicating with the at least one rectangular receiving space, and at least one dual rail, with each one of the at least one rectangular receiving space having multiple rails mounted respectively on four corners of the at least one rectangular receiving space, with each rail having two rail bodies connected with each other at an angle of 90° and a sliding channel defined between the two rail bodies and facing the at least one rectangular receiving space, with the sliding channel of each rail having a shape being symmetric with respect to a diagonal line of the two rail bodies of the rail, wherein each one of the at least one dual rail comprises a rail board, a baffle connected perpendicularly with the rail board, and two sliding channels located respectively at two sides of the baffle and being symmetric with respect to a diagonal line of the at least one dual rail; and at least one drawer unit mounted slidably in each one of the at least one rectangular receiving space, with each one of the at least one drawer unit having at least one pair of connection units, and with each connection unit connected slidably with a respective one of the multiple rails and comprising a sliding rod.

2. The drawer cabinet as claimed in claim 1, wherein each rail comprises an escaping notch defined in an outer corner of a conjunction of the two rail bodies of the rail.

3. The drawer cabinet as claimed in claim 2, wherein the sliding channel of each rail comprises two rectangular channel grooves, and wherein the sliding rod of each connection unit comprises two rod bodies symmetric to each other.

4. The drawer cabinet as claimed in claim 3, wherein each connection unit is connected integrally with a corresponding one of the at least one drawer unit.

5. The drawer cabinet as claimed in claim 3, wherein each connection unit comprises a connection board abutting a corresponding one of the at least one drawer unit, and wherein the sliding rod is connected with a side edge of the connection board.

6. The drawer cabinet as claimed in claim 3, wherein each connection unit comprises a connection board abutting a corresponding one of the at least one drawer unit and an extension tab extending inclinedly from a side edge of the connection board, and wherein the sliding rod is connected with a side edge of the extension tab.

7. The drawer cabinet as claimed in claim 1, wherein the at least one pair of connection units comprises two pairs of connection units mounted respectively on top edges and bottom edges of two sides of the at least one drawer unit.

8. The drawer cabinet as claimed in claim 1, wherein the cabinet body comprises at least two openings in at least two perpendicular directions, wherein the multiple rails comprises two groups of four rails mounted respectively on the four corners of the at least one receiving space respectively along each of the at least two openings in the at least two perpendicular directions, and wherein each rail is discontinuous at a conjunction with a perpendicular corresponding rail.

9. A drawer cabinet comprising:

a cabinet body comprising at least one rectangular receiving space, at least one opening communicating with the at least one rectangular receiving space, and at least two openings in at least two perpendicular directions, wherein the at least one rectangular receiving space comprises two groups of four rails mounted respectively on four corners of the at least one rectangular receiving space respectively along each of the at least two openings in the at least two perpendicular directions, with each rail having two rail bodies connected with each other at an angle of 90° and a sliding channel defined between the two rail bodies and facing the at least one rectangular receiving space, with the sliding channel of each rail having a shape being symmetric with respect to a diagonal line of the two rail bodies of the rail, and wherein each rail is discontinuous at a conjunction with a perpendicular corresponding rail; and at least one drawer unit mounted slidably in each one of the at least one rectangular receiving space, with each one of the at least one drawer unit having at least one pair of connection units, and with each connection unit connected slidably with a respective one of the two groups of four rails and comprising a sliding rod.

10. The drawer cabinet as claimed in claim 9, wherein each rail comprises an escaping notch defined in an outer corner of a conjunction of the two rail bodies of the rail.

11. The drawer cabinet as claimed in claim 10, wherein the sliding channel of each rail comprises two rectangular channel grooves, and wherein the sliding rod of each connection unit comprises two rod bodies symmetric to each other.

12. The drawer cabinet as claimed in claim 11, wherein each connection unit is connected integrally with a corresponding one of the at least one drawer unit.

13. The drawer cabinet as claimed in claim 11, wherein each connection unit comprises a connection board abutting a corresponding one of the at least one drawer unit, and wherein the sliding rod is connected with a side edge of the connection board.

14. The drawer cabinet as claimed in claim 11, wherein each connection unit comprises a connection board abutting a corresponding one of the at least one drawer unit and an extension tab extending inclinedly from a side edge of the connection board, and wherein the sliding rod is connected with a side edge of the extension tab.

15. The drawer cabinet as claimed in claim 9, wherein the at least one pair of connection units comprises two pairs of connection units mounted respectively on top edges and bottom edges of two sides of the at least one drawer unit.

* * * * *